US007490613B2

(12) United States Patent
Iordan

(10) Patent No.: US 7,490,613 B2
(45) Date of Patent: Feb. 17, 2009

(54) SMOKING DEVICE WITH SELF-CONTAINED IGNITION MEANS

(76) Inventor: George Iordan, 562 Best Rd., Moira, NY (US) 12957

( * ) Notice: Subject to any disclaimer, the term of this patent is extended or adjusted under 35 U.S.C. 154(b) by 312 days.

(21) Appl. No.: 10/777,579

(22) Filed: Feb. 12, 2004

(65) Prior Publication Data

US 2004/0187879 A1 Sep. 30, 2004

Related U.S. Application Data

(60) Provisional application No. 60/320,028, filed on Mar. 20, 2003.

(51) Int. Cl.
*A24F 3/00* (2006.01)

(52) U.S. Cl. ..... 131/185; 131/178

(58) Field of Classification Search ..... 131/185
See application file for complete search history.

(56) References Cited

U.S. PATENT DOCUMENTS

| | | | | |
|---|---|---|---|---|
| 1,053,039 | A | 2/1913 | Karnes | |
| 1,157,771 | A * | 10/1915 | Fulton | 131/185 |
| 1,938,874 | A | 12/1933 | Stone | |
| 2,455,583 | A | 12/1948 | Ireson | |
| 2,532,820 | A | 12/1950 | Pelt | |
| 2,549,727 | A | 4/1951 | Van Toll | |
| 2,588,034 | A | 3/1952 | O'Neill, Jr. | |
| 3,079,927 | A * | 3/1963 | Fassbender | 131/194 |
| 3,402,723 | A | 9/1968 | Hu | |
| 3,408,153 | A * | 10/1968 | Ishiguro | 431/143 |
| 3,698,400 | A * | 10/1972 | Tucker | 131/185 |
| 3,863,647 | A * | 2/1975 | Unger | 131/179 |
| 3,882,876 | A | 5/1975 | Covington | |
| 4,276,892 | A | 7/1981 | Isquinta | |
| 4,810,187 | A | 3/1989 | Nitta | |
| 5,960,783 | A * | 10/1999 | Schubert et al. | 126/41 R |
| 2002/0069886 | A1 * | 6/2002 | Couch | 131/173 |

FOREIGN PATENT DOCUMENTS

| | | |
|---|---|---|
| WO | WO 82/ 03536 A1 | 10/1982 |

* cited by examiner

*Primary Examiner*—Philip C Tucker
*Assistant Examiner*—Michael J Felton
(74) *Attorney, Agent, or Firm*—Howard J. Walter, Jr.

(57) ABSTRACT

A smoking device having a self-contained ignition mechanism. The device is in the form of a smoking pipe having a stem and a bowl, a mouthpiece extends through the stem and is connected below the bottom of the bowl; contained substantially within the stem is an igniter and a fuel tank for generating a flame in response to an actuator located on the side of the stem. The igniter generates a torch-like flame which extends into the combustion chamber at a point above the mouth piece pipe at ignite combustible material placed in the bowl.

7 Claims, 4 Drawing Sheets

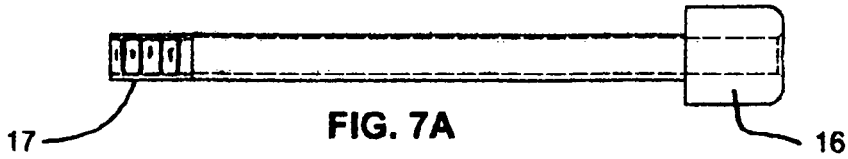
FIG. 7A
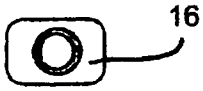
FIG. 7C
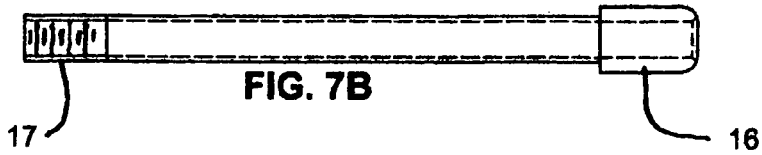
FIG. 7B
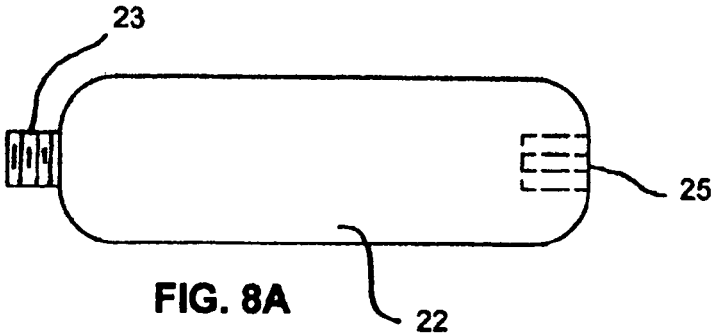
FIG. 8A
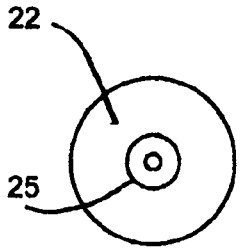
FIG. 8B
FIG. 1A
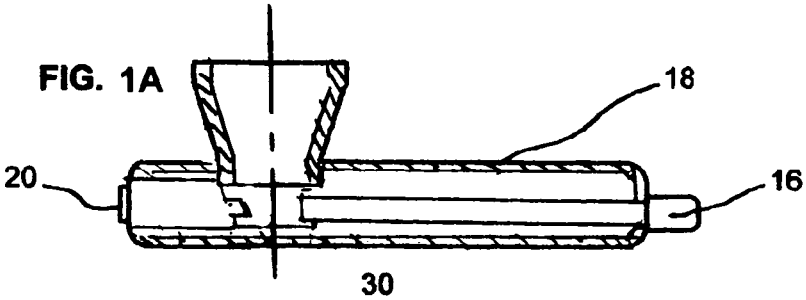

SMOKING DEVICE WITH SELF-CONTAINED IGNITION MEANS

CROSS-REFERENCE TO RELATED APPLICATION

Priority is claimed in Provisional Patent Application Ser. No. 60/320,028 filed Mar. 20, 2003.

BACKGROUND OF THE INVENTION

This invention relates to smoking devices and more particularly to smoking devices having a self-igniting feature.

The idea for a combination smoking device and lighter has been known for almost 100 years, see U.S. Pat. No. 1,053,039 to Karnes, which teaches a cumbersome pipe/lighter/storage compartment combination, which meets the functional requirements for a self-igniting smoking device at the cost of considerable distraction in the appearance of the device.

Typical techniques for achieving a combined smoking device and lighter include the idea of mimicking a human in lighting the combustible smoking material as would be accomplished by an external match or lighter in which the flame is applied to the top of the bowl. See, for example U.S. Pat. No. 1,938,874 to Stone, U.S. Pat. No. 2,455,583 to Ireson, U.S. Pat. No. 2,532,820 to Pelt, U.S. Pat. No. 2,549,727 to Van Toll, PCT Published Application WO-82/03536 to Stewart and particularly U.S. Pat. No. 2,588,934 to O'Neill, Jr. in which a lighter of conventional design is stored in the stem and is movable to the top of the bowl to effect ignition of the contents.

The disadvantages of the 'top lighters' is that either the presence of a cumbersome mechanism is required or extensive design is required to incorporate the ignition means within the form of the smoking device.

Another approach to a self-igniting a pipe-like smoking device is to ignite the contents of the smoking bowl from the bottom of the bowl, as taught in U.S. Pat. No. 1,157,771 to Fulton. Other representative examples of 'bottom lighters' are U.S. Pat. No. 3,402,723 to Hu and U.S. Pat. No. 3,882,876 to Covington. These last three mentioned references also provide for ignition by and electric element placed within the bowl of the smoking device.

Also known is the use of piezoelectric phenomena to provide the ignition means, see U.S. Pat. No. 3,698,400 to Tucker.

The disadvantages of the above 'bottom lighters' is that the ignition of the combustible material, normally aided by drawing of air through the mouthpiece, is hindered by the fact that the drawing of air will prevent the ignition because the ignition source is downstream from the contents of the bowl.

Finally, there is U.S. Pat. No. 4,276,892 to Isquinta which teaches the use of a moveable ignition means which extends in the bowl during the ignition phase of using the smoking device and is withdrawn after ignition.

Again, the complexity of such a mechanism is overwhelming.

SUMMARY OF THE INVENTION

Accordingly, it is an object of the instant invention to provide a smoking device/lighter combination in which the ignition means is entirely contained within the basic elements of the device and which does not include an open flame.

Another object is to provide a smoking device/lighter combination in which the point of ignition is within the central portion of the bowl allowing the ignition of the combustibles to be aided by the drawing of air through a mouthpiece of the device.

These and other objects are achieved by the instant invention in providing a small combination smoking device and self-igniting means in which the ignition portion of the combination is contained entirely within the interior of the smoking device itself and where the point of ignition is other than at the top or the bottom of the bowl containing the smoking material.

In addition, the smoking device is small and compact such that it easily fits into one's pocket before, during and after use, if one so desires.

The invention will be more fully understood when reviewed in terms of the following drawings and description.

BRIEF DESCRIPTION OF THE DRAWINGS

FIG 1A shows the relationship of the igniter and the mouth piece along the lines A-A of FIG. 1.

FIGS. 7A, 7B and 7C are top, side and end views, respectively, of the separate mouth piece component.

FIGS. 8A and 8B are top and end views, respectively, of the separate fuel tank component.

DETAILED DESCRIPTION OF THE INVENTION

Figure 1:
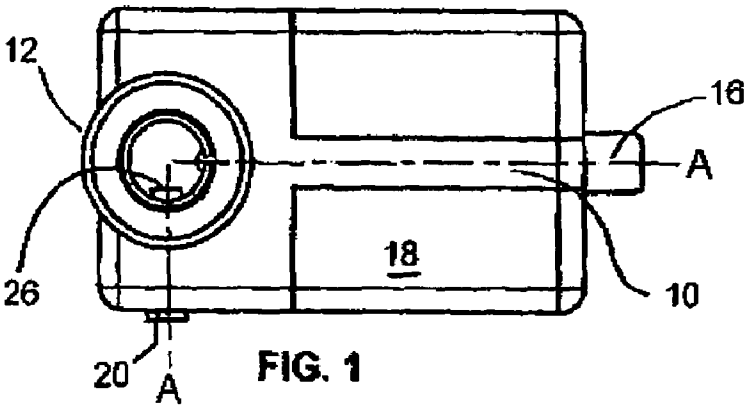
FIG. 1 is a top view of the smoking device of the invention.

Referring to FIG. 1, the smoking device of the instant invention has a pipe-like configuration and includes a stem portion 10, a tobacco or other combustible material containing combustion chamber, the upper portion of which comprises a bowl 12 and an optional cap or cover, not shown. Within the stem 10 there is a mouth piece pipe 16 which passes through the stem where it is attached by screw threads to the main body in communication with the opening in the device below where the bottom of the bowl 12 is mounted. On the side of the stem communicating with the combustible material or smoking material receptor below the bowl 12 is an igniter, the end of which 26 protrudes into the opening below the bowl. Optionally, there may be provided vent holes, not shown, in the bowl in order to facilitate use of the smoking device with a cap installed. Mounted on the side of the device is a button 20 used to activate the igniter. Finally, there is provided a pair of optional removable, slidable covers 18 allowing access to the interior of the device for the reception of a fuel tank and other material such as an additional supply of combustible material.

The materials of construction of the smoking device can be materials such as metals, specifically aluminum or stainless steel, or hard thermosetting plastics which can be molded or machined to the desired shapes necessary to facilitate the manufacture of the invention. Traditional wood may also be used. Because the bowl 12 can become quite hot in use, it is preferred to use a material with a low coefficient of thermal conductivity for the exterior of bowl 12. The bowl may also be separately insulated.

Figure 2:
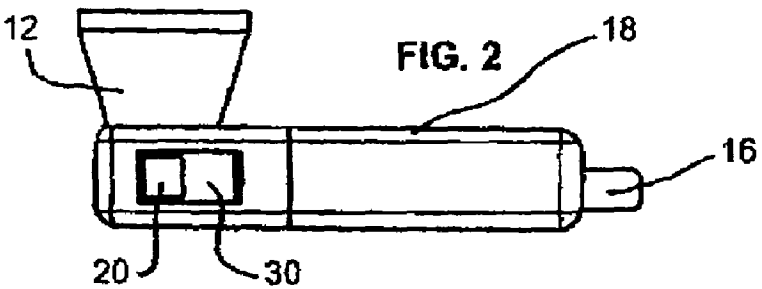
FIG. 2 is a side view of the invention showing the relationship of the igniter to the bowl.

Referring now to FIG. 2, there is shown a side view of the smoking device showing the push button or actuator 20, a part of the igniter 30 protruding from the side of the device. Actuation of button 20 causes the ignition mechanism, shown in FIG. 6, to provide a torch-like flame, not shown, to enter the receptacle just below bowl 12.

Figure 3:
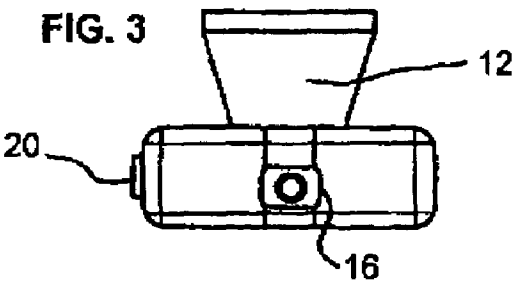
FIG. 3 is a side view of the invention showing the mouth piece side.

FIG. 3 is a end view of the smoking device of the invention looking at the mouth piece end. Here it can be seen that the mouth piece pipe 16 is mounted within the stem at a point below that of the igniter, as will be explained further in conjunction with FIG. 6.

Figure 4:
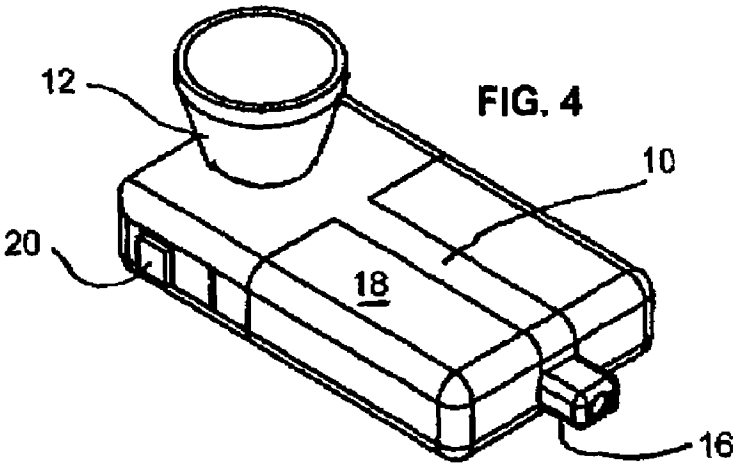
FIG. 4 is an isometric view of the invention showing the overall appearance of the smoking device of the invention.

FIG. 4 is an isometric view of the smoking device. Here, again, there can be seen the overall relationship between of the bowl 12, the stem 10, the the igniter push button 20, the mouth piece pipe16 and the removable covers 18.

FIG. 1A shows the position of the piezoelectric torch flame ignition device with respect to the mouth piece, in which the torch flame ignition device is spaced from the bottom of the combustion chamber, as can be seen in FIG. 1, such that the torch flame when ignited extends in a direction generally perpendicular to mouth piece pipe 16 and across the bottom of the combustion chamber.

Figure 5A:
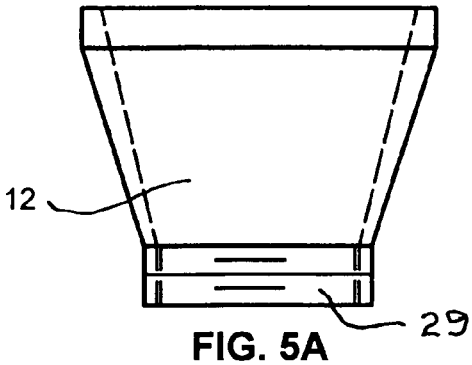
FIGS. 5A and 5B are a side view and a top view, respectively, of the separate bowl component of the invention.
Figure 5B:
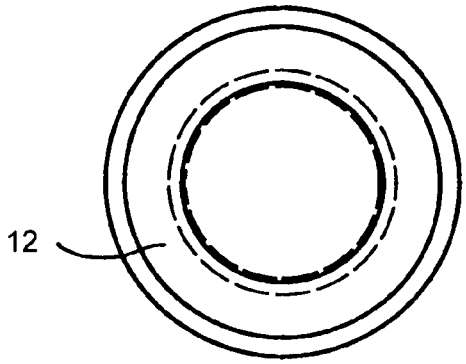

FIGS. 5A and 5B are side and top views, respectively, of the removable bowl 12 showing the threaded portion 29.

FIGS. 6A-D are several views of igniter 30 which is of the type known as a piezoelectric torch or jet flame butane or other hydrocarbon gaseous fuel lighter mechanism such as described in U.S. Pat. No. 6,589,045 to Xu, issued Jul. 8, 2003, or in U.S. Pat. No. 4,810,187, issued Mar. 7, 1989 to Nitta, the teachings of which are hereby incorporated by reference. Other igniting mechanisms capable of providing the required torch flame to bowl feature of the instant invention may also be used.

Figure 6A:
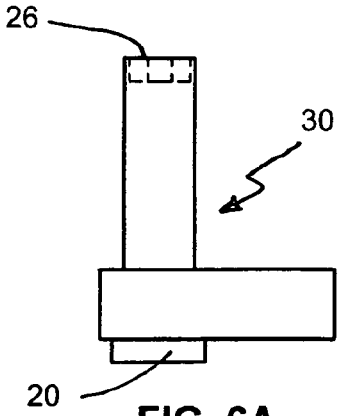
FIGS. 6A, 6B, 6C and 6D are top, front, side and isometric views, respectively, of the separate igniter component.

FIG. 6A is a top view of igniter 30 showing relationship between push button 20 and the active end 26 which protrudes slightly into the combustion chamber. This arrangement allows the torch-like flame to protrude into the combustible material in the bowl facilitating its ignition.

Figure 6D:
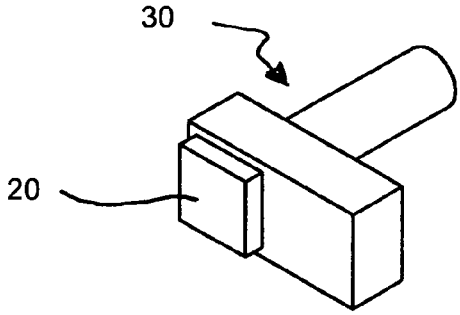
Figure 6B:
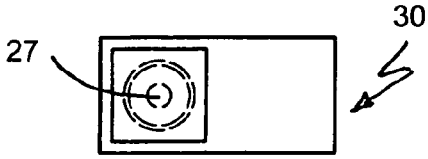

FIG. 6B is an end view of the igniter 30 showing the flame nozzle tip 27, the source of the torch or jet flame.

Figure 6C:
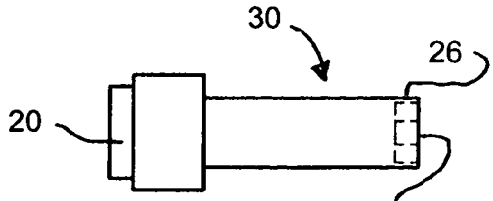

FIG. 6C is a side view of the igniter 30 showing the relationship between the elements 20, 26 and 27.

FIG. 6D is an isometric view of the igniter 30.

FIGS. 7A, 7B and 7C are top, side and end views, respectively, of the mouth piece pipe 16 showing the threaded portion 17 of the pipe which facilitates the ease of removal for cleaning.

FIGS. 8A and 8B are side and end views, respectively, of the removable fuel tank 22 which has at its one end a threaded nipple 23 for delivering fuel to the igniter and at its other end a fitting 25 for refilling the fuel tank.

Figure 9:
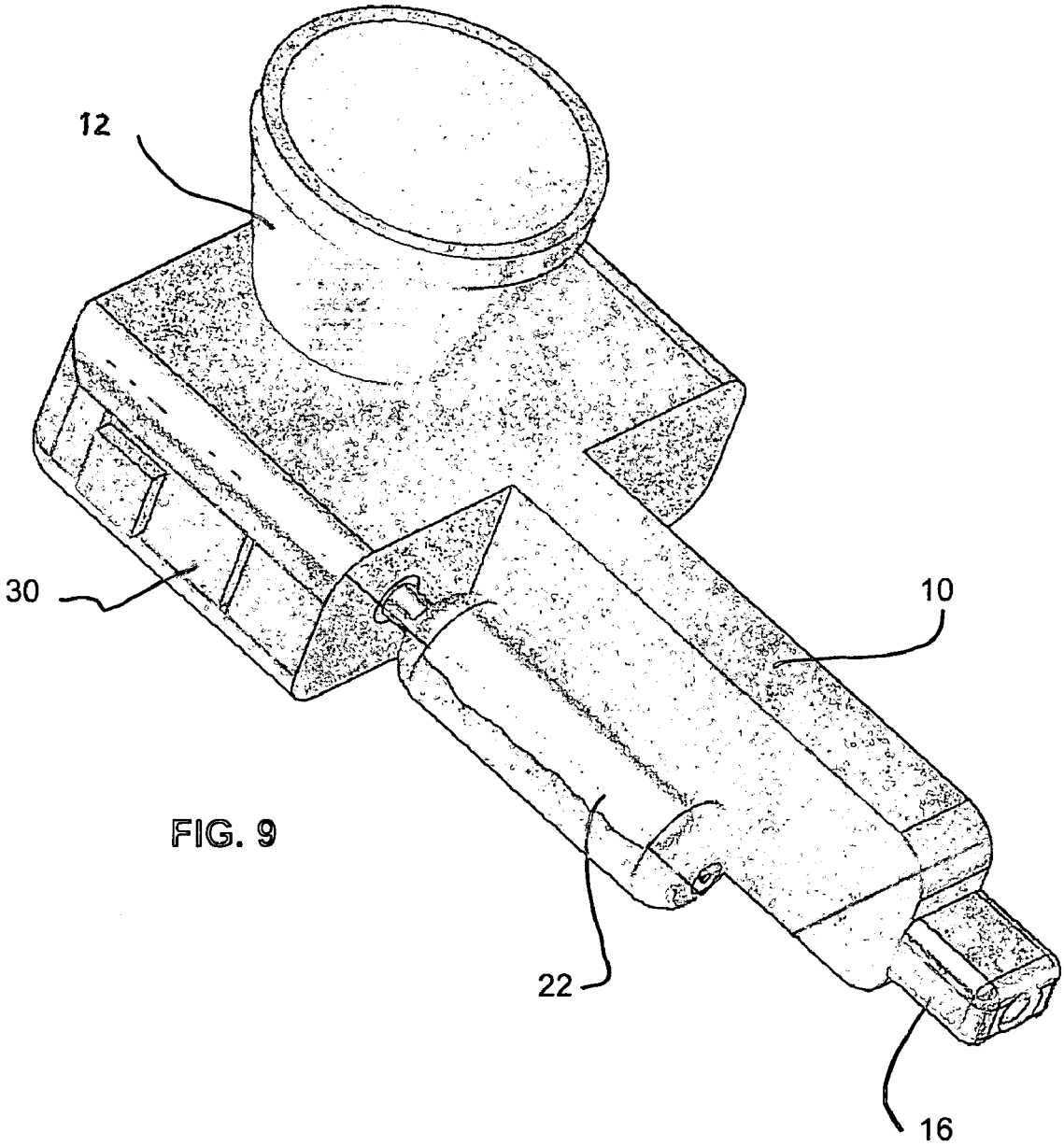
FIG. 9 is an isometric view showing the assembled components of the smoking device with the covers removed.

FIG. 9 is an isometric view of the assembled smoking device with the covers removed, showing the bowl 12, the mouth piece pipe and the fuel tank screwed into the body already containing the igniter. In its preferred form the device is quite small measuring about seven centimeters in length, three and one half centimeters in width by about two and one half centimeters in height.

While the invention has been described in terms of a single embodiment, those skilled in the art will recognize that other configurations, features and materials may be substituted for those shown. Features purely decorative in nature may be added to the stem or the bowl such as flashing lights powered by the piezoelectric ignition mechanism or by a separate battery added to the storage compartment revealed by the removal of cover 18.

What is claimed is:

1. A smoking device comprising:

a combustion chamber comprising a bowl for containing combustible material to be burned;

a mouth piece pipe communicating with the combustion chamber; and a piezoelectric torch flame ignition device extending into the combustion chamber above the mouth piece pipe and below the bowl for generating a torch flame capable of extending into the combustion chamber in a direction generally perpendicular to the mouth piece pipe and across the bottom of the combustion chamber to ignite combustible material within the combustion chamber.

2. The smoking device of claim 1 wherein the combustion chamber, bowl, and mouth piece pipe are formed of metal.

3. The smoking device of claim 2 wherein the metal is aluminum.

4. The smoking device of claim 2 wherein the metal is stainless steel.

5. The smoking device of claim 1 wherein the piezoelectric ignition device further includes a fuel tank for gaseous fuel.

6. The smoking device of claim 1 wherein the bowl and mouth piece are removable to facilitate cleaning of the device.

7. The smoking device-of claim 1 further including removable covers covering the fuel tank.

* * * * *